US005305291A

United States Patent [19]

Kamens et al.

[11] Patent Number: 5,305,291

[45] Date of Patent: Apr. 19, 1994

[54] ALARM SETTING AND ACTUATING MECHANISM FOR ANALOG TIMEPIECE

[75] Inventors: Bruce H. Kamens, Thomaston; Paul Wuthrich, Watertown, both of Conn.

[73] Assignee: Timex Corporation, Middlebury, Conn.

[21] Appl. No.: 124,528

[22] Filed: Sep. 22, 1993

[51] Int. Cl.[5] ..... G04C 21/16

[52] U.S. Cl. ..... 368/252; 368/253

[58] Field of Search ..... 368/72–75, 368/250, 252, 253

[56] References Cited

U.S. PATENT DOCUMENTS

| | | | |
|---|---|---|---|
| 1,128,751 | 2/1915 | Brown | 368/253 |
| 3,596,460 | 4/1969 | Wuthrich | 58/19 |
| 3,775,967 | 12/1973 | Spadini | 368/252 |
| 3,832,843 | 9/1974 | Wuthrich | 368/252 |
| 4,084,104 | 4/1978 | Scheer et al. | 368/250 |
| 4,157,646 | 6/1979 | Wuthrich | 368/253 |
| 4,652,140 | 3/1987 | Nakazawa | 368/74 |

*Primary Examiner*—Vit W. Miska

*Attorney, Agent, or Firm*—William C. Crutcher

[57] ABSTRACT

An alarm setting mechanism for an analog timepiece of the type having a minute hand, an hour hand and an alarm device responsive to switch actuations. A minute setting ring and a coaxial hour setting ring are both rotatably mounted in the timepiece and include a minute alarm marker and an hour alarm marker. Both rings have crown gears coupled to a drive pinion arranged to rotate the two rings at a ratio of 12:1 to set the hour and minute markers. This is preferably accomplished using a spur tooth gear on the minute setting ring and a Geneva drive for the hour ring. A first switch is actuated in response to passage of the hour hand contacting the hour marker and a second switch is actuated in response to passage at the minute hand in close proximity to the minute marker. The alarm setting mechanism has a separate crown which is detented in three positions. The crown enables the alarm setting means to function either as a time of day alarm setting using the hour and minute markers with the conventional timepiece dial indicia, or allows the minute hand to function as a count down timer.

9 Claims, 3 Drawing Sheets

ALARM SETTING AND ACTUATING MECHANISM FOR ANALOG TIMEPIECE

BACKGROUND OF THE INVENTION

This invention relates generally to analog timepieces, such as quartz analog wristwatches having a settable alarm device. More particularly, the invention relates to an improved alarm setting mechanism for an analog timepiece.

Electric alarm timepieces are known, both of the LCD digital type and the quartz analog type with hands. An LCD digital timepiece, because of ability to program its operation through software, permits complex alarm settings and countdown timers. However, a large segment of the population still prefers analog timepieces with hour and minute hands. Analog wristwatches are governed by simple stepping motor circuits in quartz watches, or by balance wheels in mechanical watches. In order to add an alarm, some means must be provided to set the time of day at which the alarm is actuated. Various means have been proposed in the prior art for setting an analog alarm watch.

One category of alarm-setting and actuating mechanism for an analog timepiece utilizes a conventional movement to close a switch at a selected alarm time, using switch contacts which are operated by the hour hand mechanism in conjunction with a rotatable alarm setting ring. One such arrangement is shown in U.S. Pat. No. 3,596,460 issued to Paul Wuthrich on Aug. 3, 1971 and assigned to the present assignee. One switch contact is disposed on an hour wheel which is continuously rotated by the movement, and the other switch contact is disposed on an alarm setting disk with a ring gear, which is manually rotated by a pinion. An indicator marking on the disk is aligned with a selected dial time marking, at which time the alarm will be actuated by closure of switch contacts as the hour hand passes in close proximity with the selected dial time marking. Another arrangement disclosed in U.S. Pat. No. 4,157,646 issued to Paul Wuthrich on Jun. 12, 1979 utilizes a switch, wherein the hour hand itself serves as one switch contact and directly engages another contact which is on an hour setting marker on a manually rotated hour setting ring. In the foregoing alarm setting and actuating mechanisms using switch contacts operated by the hour hand mechanism, the alarm time is difficult to set precisely.

Another type of alarm setting and actuating mechanism for an analog timepiece is found in watches with multiple dials or auxiliary hands, and sometimes driven by several stepping motors, in which there are physical switches, but in which the hands are moved during an alarm setting mode to a desired alarm time. Such timepieces require an integrated circuit memory to count and store the number of pulses required to move one or more of the hands to the desired alarm time, and then, through the use of a software program stored in the integrated circuit memory, to sound the alarm when the number of timekeeping pulses are equal to this time difference pulse count. This type of timepiece is described in U.S. Pat. No. 4,652,140 issued Mar. 24, 1987 to Nakazawa and is also utilized in many commercially available watches such as Citizen Multi-chronograph Watch Cal. No. 6850. The need for auxiliary dials and hands, multiple stepping motors, and integrated circuit memory adds to the cost and setting complexity of the alarm timepiece.

It would be desirable to utilize the conventional movement of a quartz analog watch with conventional hour and minute hands to set and actuate the alarm mechanism. It would also be desirable to have a simplified alarm setting and actuating mechanism without the need for an integrated circuit with memory or requiring multiple dials or stepping motors. Lastly, it would be desirable to provide a minute countdown timer using the minute hand in a conventional movement.

Accordingly, one object of the present invention is to provide an improved alarm-setting and actuating mechanism utilizing a conventional analog movement.

Another object of the invention is to provide an improved alarm-setting and actuating mechanism with improved accuracy for activating the alarm using conventional hour and minute hands.

Still another object of the invention is to provide an improved alarm setting mechanism having both time of day alarm and a count down timer using the minute hand.

SUMMARY OF THE INVENTION

Briefly stated, the invention involves an improved alarm setting mechanism for an analog timepiece of the type having at least a minute hand and an hour hand and an alarm device responsive to switch actuations. A minute setting ring and a coaxial hour setting ring are both rotatably mounted in the timepiece and include a minute alarm marker and an hour alarm marker. Both rings are geared to a gear driving means arranged to rotate the two rings at a ratio of 12:1 to set the hour and minute markers. This is preferably accomplished using a spur tooth gear on the minute setting ring and a Geneva drive for the hour ring. A first switch is actuated in response to a selected position of the minute hand with respect to the minute marker and a second switch is actuated in response to a selected position of the hour hand with respect to the hour marker. Circuit means are connected to the alarm device and at least one of the switches. The circuit means enables the alarm setting means to function either as a time of day alarm setting using the hour and minute, or allows the minute hand to function as a count down timer using only the minute marker.

DRAWING

The invention, both as to organization and method of practice, together with further objects and advantages thereof, will best be understood by reference to the following description, taken in connection with the accompanying drawings, in which:

FIG. 1 is a simplified diagrammatic view of a quartz analog wristwatch illustrating detent positions of the time setting and alarm setting crowns, FIG. 2 is an enlarged plan view of one quarter of a watch dial illustrating alternate markings on the alarm setting rings, FIG. 3 is a side elevational drawing in cross section of a timepiece eliminating conventional elements and showing only elements relevant to the invention, FIG. 4 is a fragmentary view of the minute setting ring and hour setting ring drive mechanism, taken along lines IV—IV of FIG. 3, FIG. 5 shows the drive mechanism of FIG. 4 in a different position, and FIG. 6 is a simplified logic circuit illustrating the switch connections for actuating the audible alarm device in the timepiece.

DESCRIPTION OF THE PREFERRED EMBODIMENT

Figure 1:
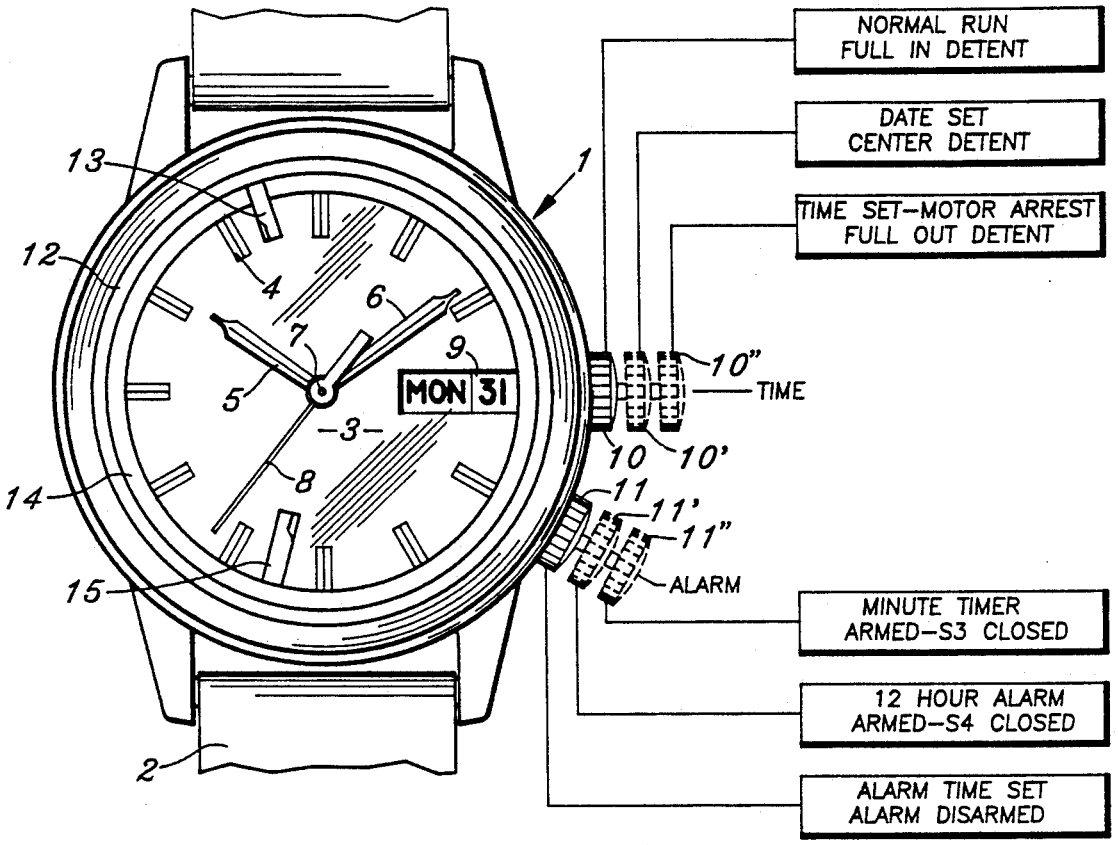

FIG. 1 of the drawing illustrates a timepiece, here a quartz analog wristwatch, having a watch case 1, portions of a strap 2 for attachment to the wrist, and dial 3 with time indicating indicia such as "sticks" 4. The timepiece has an internal conventional quartz analog movement including a stepping motor, gear train and pulse generating IC on a printed circuit (PC) board and is powered by an energy cell. The movement serves to drive an hour hand 5 and minute hand 6 in a 12:1 ratio about a central axis 7. Also shown but not relevant to the present invention, are a second hand 8 and a day/-date indicating window 9. A conventional manually operated time setting crown 10 has three detent positions, the second and third positions indicated in dotted line by reference numerals 10' and 10" respectively.

In accordance with the present invention, a manually actuated alarm setting and actuating crown 11 is arranged at a convenient location on the case 1 such as the four o'clock position. Crown 11 similarly has three detent positions, the second and third of which are shown in dotted lines by reference numerals 11' and 11".

Further in accordance with the present invention, crown 11 serves to operate the alarm setting mechanism which is the subject of the present invention. Coaxially disposed about the central axis 7 are two alarm setting rings. The outer ring comprises a minute setting ring 12, which has a minute alarm marker 13 attached thereto. The inner ring comprises an hour setting ring 14 which includes an hour alarm marker 15 attached thereto.

Figure 2:
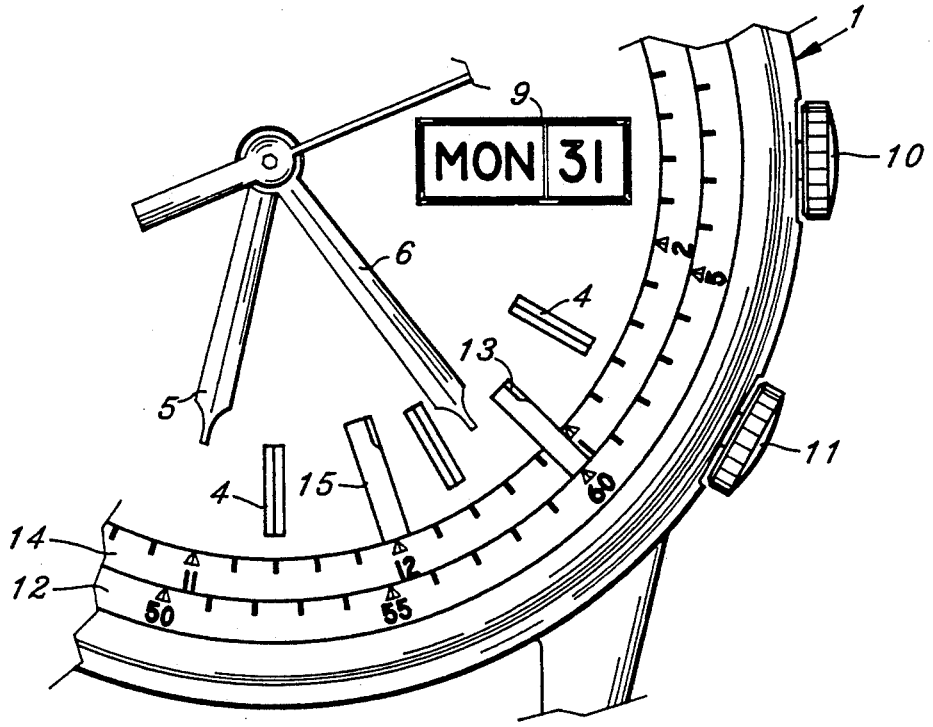

FIG. 2 is an enlarged plan view showing the lower right hand comer of the watch of FIG. 1, with the hands in a different position , as well as minute marker 13 and hour marker 15 which have been rotated into the field of the drawing in FIG. 2. The minute setting ring 12 may optionally be provided with sixty minute graduations as indicated which will be utilized when the timepiece is used as a minute countdown timer. The minute graduations commence at the location of the minute alarm marker 13. Similarly, the hour setting ring 14 may optionally be provided with a circumferential register indicating twelve hours with intermediate markings at 1/5 hour intervals, commencing at the hour alarm marker 15. The minute setting ring numerals and the hour register numerals proceed counterclockwise from the respective minute and hour markers.

Figure 3:
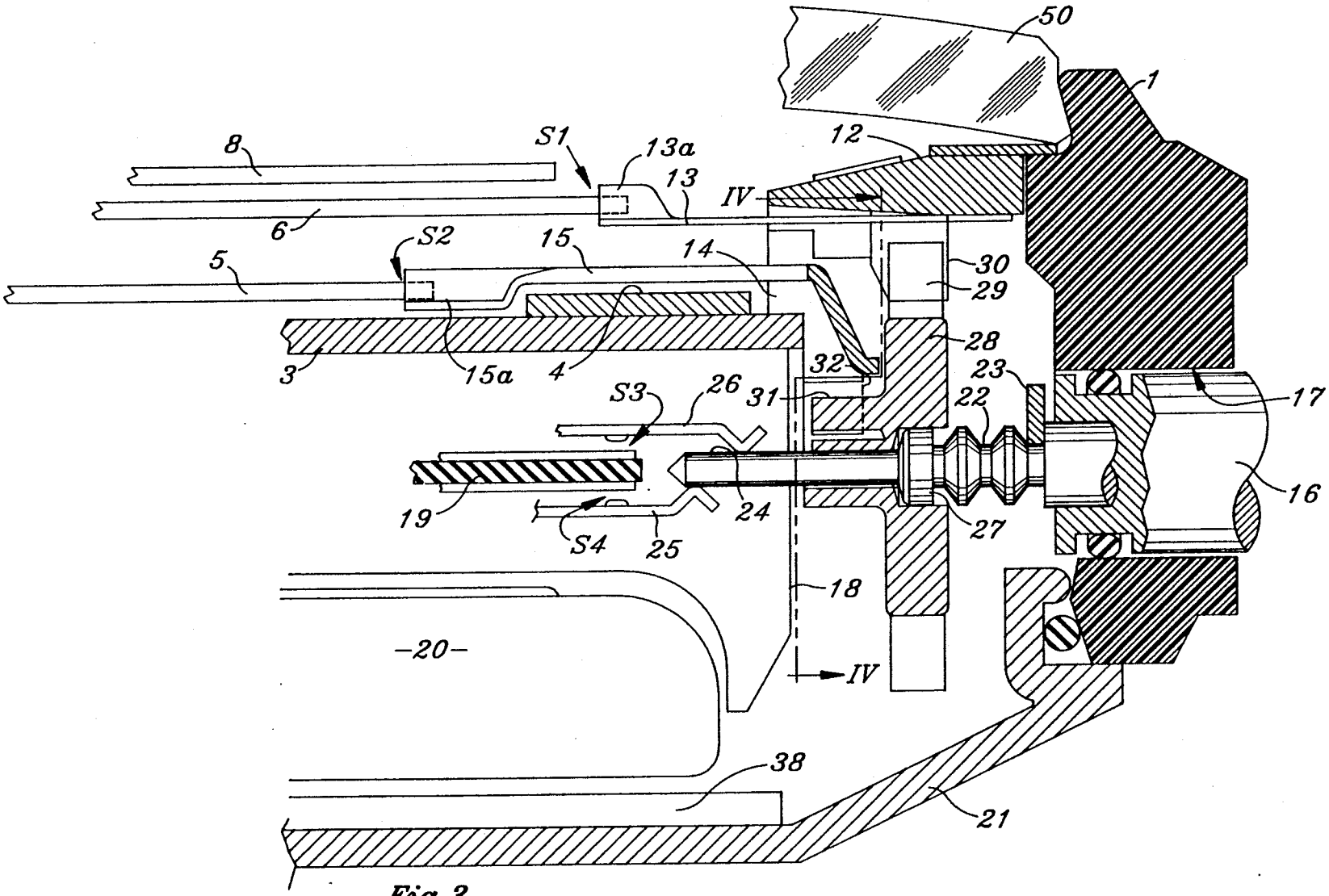

Referring now to FIG. 3 of the drawing, a cross sectional elevation view is shown taken through the axis of the alarm setting crown 11 positioned in its innermost position for setting the alarm time rings when the alarm is disarmed. Crown 11 (not shown in FIG. 3) is connected to a rotatable and axially slidable stem 16 passing through an aperture 17 in watch case 1. Portions of conventional elements of the timepiece are shown such as a transparent lens 50 held in a peripheral groove in case 1 for viewing the watch dial 3 and the time indicating indicia 4. An inner frame 18 supports the gear train (not shown) and a PC board 19. The frame includes a lower cavity housing an energy cell 20 held in place by a case back 21 supported in frame 1.

The tips of the watch hour hand 5, minute hand 6 and seconds hand 8 are seen in FIG. 3. Rotatably mounted in the case 1 are the minute setting ring 12 and the hour setting ring 14. The hour ring marker 15 and the minute ring marker 13 are shown rotated into the plane of the FIG. 3 cross section. Markers 13, 15 are electrically conductive strips with tabs 13*a*, 15*a* respectively disposed in the paths of the minute and hour hands respectively, which are also electrically conductive. When minute hand 6 electrically contacts tab 13*a*, a switch closure is completed designated S1. When hour hand 5 makes contact with tab 15*a*, a switch closure is completed designated S2.

While the S1 and S2 switch closures are illustrated as direct contact made between the watch hands and the metal markers attached to the alarm setting rings, equivalent structures are known in the prior art which are designed to close a switch when the hand is in a preselected position with respect to the alarm setting marker. For example, in assignee's aforementioned U.S. Pat. No. 3,596,460 which is incorporated herein by reference, a switch closure is made when the hour wheel (rotatable in synchronism with the hour hand) makes electrical contact with an alarm setting disk at the same time as the hour hand passes in close proximity with the time selected by the indicator marker. The precise means of making switch closures when the hour and minute hand come to a preselected position with respect to their respective hour alarm markers and minute alarm markers attached to the setting rings is not a material part of the present invention and it is intended to include such known equivalent switch closure systems.

Other switches to arm and disarm the alarm are operated by the axial movement of alarm stem 16. The body of stem 16 inside the watch case 1 is shaped to provide three detent grooves such as 22 which cooperate with a detent spring 23 to provide three axial positions of stem 16 (corresponding to crown positions 11, 11' and 11"). A stem extension member 24 cooperates with two spring contact members 25, 26 shown in simplified form on either side of PC board 19. Contacts on springs 25, 26 and leads on PC board 19 cooperate to provide a switch closure S3 when the crown 11 is fully withdrawn to its outermost position and a switch closure S4 when crown 11 is in the intermediate or middle position. Both switches S3 and S4 are open when crown 11 is in its innermost position as shown in the solid lines in FIG. 3.

In accordance with the present invention, rotation of alarm setting crown 11 and the alarm stem 16 when the crown 11 is pushed in will cause minute setting ring 12 and hour setting ring 14 to rotate with a 12:1 ratio. This mechanism is described as follows. Stem 16 includes a cylindrical friction clutch element 27 which engages a cavity in a special drive pinion 28 when stem 16 is in its innermost axial position as shown in FIG. 3. Drive pinion 28 includes outer spur gear teeth 29 which engage teeth of a minute ring crown gear 30 attached to minute setting ring 12. Drive pinion 28 further includes a Geneva drive pinion 31 which engages a Geneva drive crown gear attached to hour setting ring 14.

Figure 4:
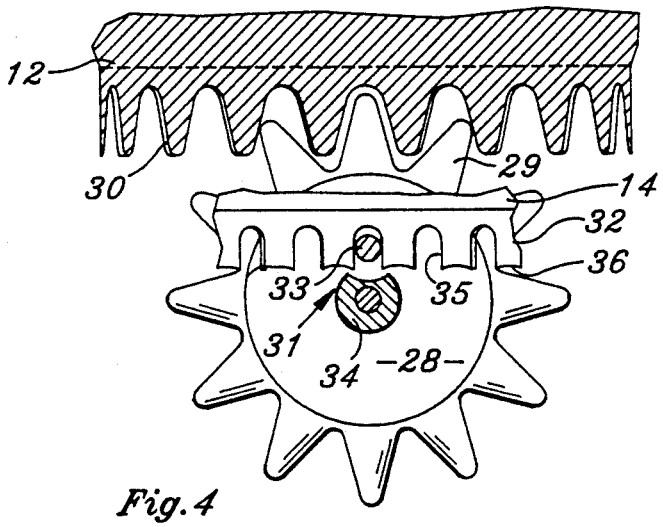
Figure 5:
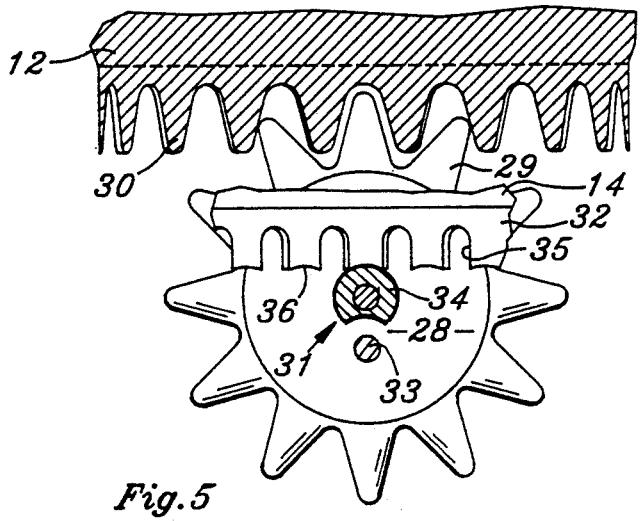

Reference to the partial views in FIGS. 4 and 5 illustrates the 12:1 gear drive. Twelve spur teeth 29 on drive pinion 28 mesh with sixty spur teeth on minute ring crown gear 30 so as to rotate the minute setting ring continuously when drive pinion 28 is rotated. Geneva drive pinion 31 comprises a pin 33 and cam 34 cooperating respectively with teeth 35 and cusps 36 to provide an intermittent rotation of the Geneva drive crown gear ring 32 in a known manner. Crown gear 32 has sixty teeth which are intermittently advanced, one tooth at a time, upon each complete rotation of drive pinion 28. FIG. 4 illustrates the Geneva crown gear 32 and drive pinion 28 in one position when pin 33 is positioned between teeth 35 and advancing the crown gear. FIG. 5 illustrates the "dwell" between advances when cam 34 is rotating within the cusps 36 on the end of teeth 35 so as not to advance the crown gear.

Figure 6:
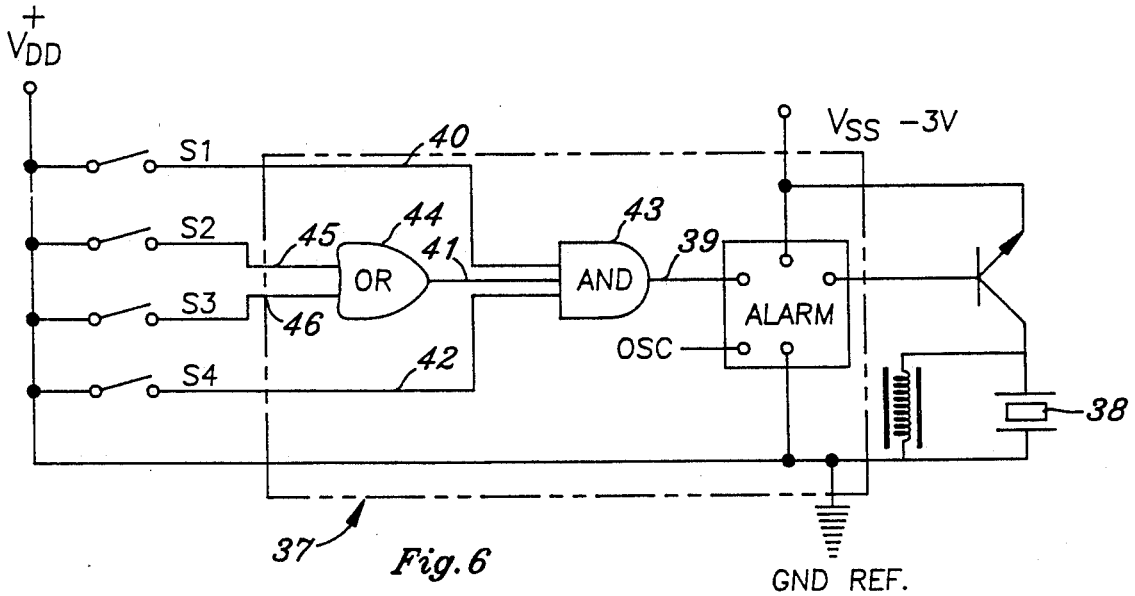

FIG. 6 illustrates a suitable electrical circuit and logic diagram used to actuate an audible conventional watch alarm, illustrated in diagrammatic form. The alarm comprises an alarm driver integrated circuit chip 37 connected to provide audible output from a piezoelectric alarm 38 when an input lead 39 is connected to a positive energy cell terminal. According to electronic watch conventional practice, the positive terminal is grounded. Three leads 40, 41, 42 are connected as inputs to a logical AND circuit 43. Lead 41 is connected as the output of a logical OR 44 having input leads 45, 46. Switch closures S1, S2, S3 and S4 are connected to leads 40, 45, 46 and 42 respectively on one side of the switches and connected in common to the grounded positive battery terminal (according to quartz timepiece convention) at the terminals on the other side of the switches. As indicated in the diagram, the audible alarm will sound when either switch S2 or switch S3 is closed, provided also that switch S1 and switch S4 are also both closed.

OPERATION

The above described alarm setting mechanism may be used to cause the timepiece to operate either as a precise setting for a time of day alarm, or as a minute countdown timer. First describing the setting of the time of day alarm, the crown 11 in its position shown in FIG. 3 (in which both switches S3 and S4 are open to disarm the alarm) is manually turned in either direction to rotate the minute setting ring and the hour setting ring. These rings rotate with a 12:1 ratio, much as the hands of a timepiece, with the exception that the minute setting ring rotates continuously whereas the hour setting ring rotates intermittently, i.e., jumps from one 1/5 hour setting to the next. Markers 13, 15 are rotated to the position on the regular dial indicia at the time of day at which the alarm should be actuated. In the example shown in FIG. 2, the alarm is set at 22½ minutes after five. The alarm is then armed by retracting crown 11 to its intermediate position 11'. Although minute hand 6 will repeatedly make contact with marker switch 13 once per hour, the alarm will not be actuated until both switches S1 and S2 are closed, i.e., when minute hand 6 contacts marker 13 and when hour hand 5 simultaneously contacts hour marker 15. Therefore, a much more precise alarm setting is provided than with prior art devices, which used only the hour hand contact switch.

The improved alarm setting mechanism also enables the minute hand of the timepiece to function as a count down timer for elapsed times up to one hour. With the crown 11 in the innermost position, so that switches S3 and S4 are open and the alarm unarmed, crown 11 is rotated in either direction to rotate the hour alarm markers and minute alarm markers as before. In this case, however, only the sixty minute graduations on the minute setting ring are used, together with the minute hand 6. Referring to the drawing of FIG. 2, the minute setting ring is rotated until the minute hand 6 points at the desired number of minutes in a count down (60 minutes maximum) as read on the outer minute graduation marks. In this case, the minute hand 6 indicates slightly more than 58 minutes for the count down period.

Withdrawal of crown 11 to the outermost position 11'' closes both switches S3 and S4 to arm the count down timer. Referring to the logic diagram of FIG. 6, the logic conditions for AND 43 are fulfilled when switch S1 is closed by the minute hand 6 contacting the minute alarm marker 13. The alarm is stopped by pushing in crown 11.

Both the hour and minute graduations may be employed in a similar manner by pointing the hour hand 5 and minute hand 6 at the graduations indicating number of hours and minutes remaining in the countdown period until the alarm is sounded, and then arming the hour/minute countdown alarm by withdrawing crown 11 to the intermediate position.

While there has been described what has been considered to be the preferred embodiment of the invention, other modifications will occur to those skilled in the art, and it is desired to secure in the appended claims all such modifications as fall within the true spirit and scope of the invention.

We claim:

1. Alarm setting mechanism for analog timepiece having a minute hand and an hour hand both rotatable about an axis at a 12:1 ratio and an alarm device responsive to switch actuations, said alarm setting mechanism comprising:

a minute setting ring rotatably mounted in said timepiece coaxial with said axis and including a minute alarm marker, an hour setting ring rotatably mounted in said timepiece coaxial with said axis and including an hour alarm marker, drive means adapted to selectively rotate said minute setting ring and said hour setting ring at a ratio of 12:1 to set said hour and minute alarm markers, first switch means responsive to a selected position of said minute hand with respect to said minute alarm marker, second switch means responsive to a selected position of said hour hand with respect to said hour marker, and circuit means adapted to selectively connect either one or both of said switch means to said alarm device.

2. The combination according to claim 1, wherein said minute setting ring includes a minute crown gear attached thereto and said hour setting ring include a crown gear attached thereto, and wherein said drive means comprises a gear pinion meshing with both of said crown gears, and including a manual crown connected to said gear pinion.

3. The combination according to claim 2, wherein said minute crown gear attached to said minute setting ring is a spur gear, and wherein said hour crown gear attached to said hour setting ring is a Geneva gear.

4. The combination according to claim 1, wherein said first switch means comprises an electrically conductive minute hand and an electrically conductive minute alarm marker adapted to contact one another.

5. The combination according to claim 1, wherein said second switch means comprises an electrically conducive hour hand and an electrically conductive hour alarm marker adapted to contact one another.

6. The combination according to claim 1, and further including third switch means adapted to be operated by said drive means when said drive means is not rotating said rings, said third switch means being connected in said circuit means to enable said alarm device.

7. The combination according to claim 6, and further including fourth switch means operated by said drive means and connected in said circuit means so as to enable said alarm device upon closure of said first switch means.

8. Alarm setting mechanism for analog timepiece having a minute hand and an hour hand both rotatable about an axis at a 12:1 ratio and an alarm device responsive to switch actuations, said alarm setting mechanism comprising:

a minute setting ring rotatably mounted in said timepiece coaxial with said axis and having a spur crown gear connected thereto, said minute setting ring also having an electrically conductive minute alarm marker connected thereto, an hour setting ring rotatably mounted in said timepiece coaxial with said axis and having a Geneva crown gear connected thereto, said hour setting ring also having an electrically conductive hour alarm marker connected thereto, a drive pinion meshing with both of said crown gears and adapted to continuously rotate said minute setting gear and to intermittently rotate said hour setting gear at a ratio of 12:1 to set said hour and minute alarm markers, first switch means comprising an electrically conductive minute hand adapted to contact said minute alarm marker, second switch means comprising an electrically conductive hour hand adapted to contact said hour alarm marker, and a manual crown for said analog timepiece having a rotatable and axially slidable stem, said stem including a friction drive adapted to engage said drive gear pinion in a first axial position.

9. The combination according to claim 8, and further including third switch means and fourth switch means responsive to second and third axial positions of said stem, said circuit means including said first, second, third and fourth switch means, said circuit means adapted to enable said alarm in said second axial stem position when both first and second switch means are closed and to enable said alarm in said third axial stem position when said first switch means is closed.

* * * * *